US011589680B2

(12) United States Patent
Thierer et al.

(10) Patent No.: US 11,589,680 B2
(45) Date of Patent: Feb. 28, 2023

(54) FURNITURE ITEM WITH A ROTATABLE, WEDGE-SHAPED BED

(71) Applicant: Häfele SE & Co KG, Nagold (DE)

(72) Inventors: Sibylle Thierer, Nagold (DE); Lorenz Arnold, Unteraegeri (CH)

(73) Assignee: Hafele SE & Co KG, Nagold (DE)

( * ) Notice: Subject to any disclaimer, the term of this patent is extended or adjusted under 35 U.S.C. 154(b) by 0 days.

(21) Appl. No.: 17/659,228

(22) Filed: Apr. 14, 2022

(65) Prior Publication Data

US 2022/0232987 A1 Jul. 28, 2022

Related U.S. Application Data

(63) Continuation of application No. PCT/EP2020/071174, filed on Jul. 28, 2020.

(30) Foreign Application Priority Data

Oct. 17, 2019 (DE) ..... 20 2019 105 741.6

(51) Int. Cl.
*A47C 17/52* (2006.01)
*A47C 17/04* (2006.01)
*A47C 17/00* (2006.01)

(52) U.S. Cl.
CPC ..... *A47C 17/52* (2013.01); *A47C 17/04* (2013.01); *A47C 17/00* (2013.01)

(58) Field of Classification Search
CPC ..... A47C 17/52; A47C 17/04; A47C 17/00; A47C 31/00
USPC ..... 5/2.1, 8, 9.1
See application file for complete search history.

(56) References Cited

U.S. PATENT DOCUMENTS 3,389,411 A * 6/1968 Emery ..... A47G 9/0253 5/636
4,360,936 A * 11/1982 Keller ..... A47C 17/84 5/9.1
4,639,960 A * 2/1987 Quillen ..... A47C 27/081 5/724
4,724,558 A * 2/1988 Reiff ..... A47C 1/146 297/DIG. 3
5,448,790 A * 9/1995 Saro ..... A47C 17/045 5/632

(Continued)

FOREIGN PATENT DOCUMENTS

CN 102 907 954 A 2/2013
CN 114554911 A * 5/2022 ..... A47C 17/04

(Continued)

OTHER PUBLICATIONS

Anonymous: "Triangular bed," Feb. 3, 2016, XP055729828, Gefunden im Internet: URL: https://web.archive.org/web/20160203231341/http://june-14.com/2015/triangular-bed/[gefunden am Sep. 11, 2020] Abbildungen.

*Primary Examiner* — Robert G Santos
(74) *Attorney, Agent, or Firm* — Orbit IP

(57) ABSTRACT

A furniture item with at least one wedge-shaped bed and with a vertical axis of rotation, about which the at least one bed and/or at least one wedge-shaped functional element are/is mounted in a rotatable manner. The axis of rotation is arranged at one of the two ends of the bed or is formed by the axis of rotation of a rotary part, on which one of the two bed ends is fastened.

14 Claims, 2 Drawing Sheets

(56) References Cited

U.S. PATENT DOCUMENTS

| | | | | |
|---|---|---|---|---|
| 6,848,137 | B1 * | 2/2005 | Barnes | A47C 27/081 5/710 |
| 7,415,743 | B2 * | 8/2008 | Rubio | A47C 27/146 128/845 |
| 7,784,129 | B2 * | 8/2010 | Javaruski | A47C 21/06 5/660 |
| 8,181,295 | B1 * | 5/2012 | Mallinger | A47C 20/048 5/733 |
| 11,160,398 | B2 * | 11/2021 | Chan | A47G 9/1072 |
| 2006/0070185 | A1 * | 4/2006 | Rubio | A47C 20/04 5/706 |
| 2009/0144905 | A1 * | 6/2009 | Javaruski | A47C 21/06 5/632 |
| 2021/0015278 | A1 * | 1/2021 | Chan | A47G 9/1081 |
| 2022/0232987 | A1 * | 7/2022 | Thierer | A47C 17/04 |

FOREIGN PATENT DOCUMENTS

| | | | | |
|---|---|---|---|---|
| DE | 87 01 673 | U1 | 3/1987 | |
| DE | 93 15 634 | U1 | 3/1994 | |
| DE | 20 2013 105 344 | U1 | 1/2014 | |
| DE | 20 2014 001 974 | U1 | 4/2014 | |
| DE | 202019105741 | U1 * | 12/2019 | A47C 17/04 |
| FR | 2 123 783 | A5 | 9/1972 | |
| GB | 2 389 307 | A | 12/2003 | |
| WO | WO-2021073789 | A1 * | 4/2021 | A47C 17/04 |

* cited by examiner

FURNITURE ITEM WITH A ROTATABLE, WEDGE-SHAPED BED

CROSS-REFERENCE TO RELATED APPLICATIONS

This continuation application claims priority to PCT/EP2020/071174 filed on Jul. 28, 2020 which has published as WO 2021/073789 A1 and also the German application number 20 2019 105 741.6 filed on Oct. 17, 2019, the entire contents of which are fully incorporated herein with these references.

DESCRIPTION

Field of the Invention

The invention relates to a furniture item with at least one wedge-shaped bed.

Background of the Invention

Wedge-shaped beds are known, for example, from berth design in shipbuilding. The wedge shape has the advantage that the foot end of a bed is designed without corners, which are not normally utilized. A wedge-shaped bed is wider at the head end than at the foot end. This can be utilized for space-saving purposes. It is also possible here for the shape of the lying surface to correspond to a wedge only in part, for example it can be in the form of a cut-off wedge (truncated wedge), that is to say without any wedge tip.

SUMMARY OF THE INVENTION

In contrast, the object of the present invention is to make more flexible and efficient use of the space available in the domestic setting.

This object is achieved by a furniture item comprising at least one wedge-shaped bed and a vertical axis of rotation, about which the at least one bed and/or at least one wedge-shaped functional element are/is mounted in a rotatable manner, wherein the axis of rotation is arranged at one of the two ends of the bed or is formed by the axis of rotation of a rotary part, on which one of the two bed ends is fastened. The functional element can be, for example, a worktop or tabletop or a bench seat.

The rotary mounting of the bed allows the space available to be better utilized and the center of the space available to be configured in a variable manner. Arranging the axis of rotation at the head end or foot end of the bed makes use of the leverage achieved over the longitudinal extent of the bed, in order to make it easier for the bed to be rotated about its axis of rotation. The mounting axis here is arranged in the region of the head end or foot end, i.e., rather than having to be located directly at the head end or foot end, but it can also be located alongside the head end or foot end. This can be the case, for example, when the bed is in the form of an incomplete wedge in which, for example, the tip is absent.

For the case where the furniture item has both a bed and a functional element, which can be rotated in relation to one another, the bed and the functional element are preferably arranged at different heights, so that it is possible for the bed and the functional element to be rotated past one another.

The axis of rotation can be in the form of a rotary column of the furniture item, about which the at least one bed and/or the at least one functional element rotate/rotates. Supply connections for the bed or the functional element, that is to say, for example, electricity, network or water connections, are advantageously integrated in the rotary column, and this provides for a high level of flexibility in the utilization of space and in good adaptation to the situation in hand. The rotary column either can be arranged in a stationary manner in space ("stationary rotary column") or can be displaced as desired in space ("mobile rotary column").

In an alternative embodiment of the invention, the at least one bed comprises the axis of rotation, about which the at least one functional element is mounted in a rotatable manner; the bed together with its axis of rotation either can be arranged in a stationary manner in space or can be displaced as desired in space. In another alternative embodiment, the at least one functional element comprises the axis of rotation, about the at least one bed and possibly further functional elements are mounted in a rotatable manner; the functional element together with its axis of rotation either can be arranged in a stationary manner in space or can be displaced as desired in space.

The at least one functional element is preferably arranged above the at least one bed, so that, in a basic position of the furniture item, it fully covers the at least one bed in the upward direction so as to hide it from view and protect it from dust.

The at least one bed and the at least one functional element, in particular all the functional elements present, particularly preferably have the same wedge-shaped cross section and, in a basic position of the furniture item, can be arranged one above the other, so that they jointly form two flush sides of the furniture item. In a position in which someone can lie on the furniture item, the bed and the functional element have then been rotated in fan form in relation to one another to the extent where the lying surface of the bed is not covered in the upward direction by the functional element.

In advantageous embodiments of the invention, the at least one bed and/or the at least one functional element have/has sliders or base rollers, which slide or roll on the floor when the at least one bed or the at least one functional element rotates. It is possible here for the sliders or base rollers to be arranged at different radii about the axis of rotation, wherein the radius is advantageously greater the higher the level of the bed or the respective functional element in the furniture item.

In advantageous embodiments of the invention, the rotary part is designed in the form of a rotating door or a rotating shelf unit. The bed then acts as a lever arm, so that the rotating shelf unit together with the bed can be rotated more easily about the axis of rotation. The axis of rotation of the rotary part can be arranged in a stationary manner in space ("stationary rotary part") or so as to be displaceable in space ("mobile rotary part").

In one embodiment, the rotary wall of the furniture item is designed in the form of a rotating door or a rotating shelf unit. This embodiment has the advantage that the rotary wall can be easily pivoted by the leverage of the bed and space available can therefore be easily divided up anew. In the case of a rotating door, an amount of space which is separated off can be converted into an amount of connected space. A rotating shelf unit can be used, in one position, as a shelf unit and, in the other position, as a stowage facility which is directed away from the space available.

Further advantages of the invention can be gathered from the description, the claims and the drawing. Similarly, the features mentioned above and those explained below can each be used on their own or together in any desired combinations. The embodiments shown and described should not be understood as an exhaustive list, but rather are of exemplary character for the description of the invention.

DETAILED DESCRIPTION OF THE PREFERRED EMBODIMENTS

Figure 1A:
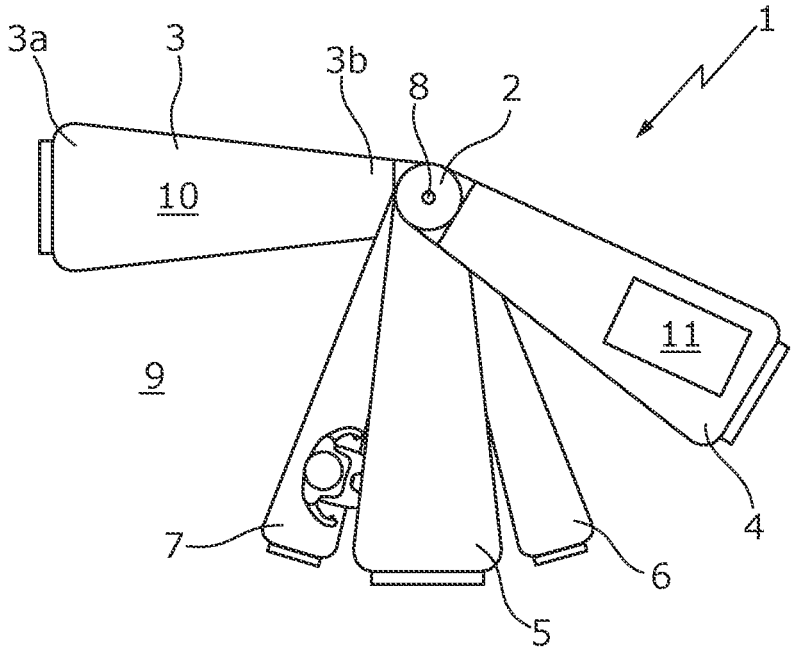
FIGS. 1*a*, 1*b* show a furniture item with a pivotably mounted, wedge-shaped bed which, in the plan view shown in FIG. 1*a*, is shown in a pivoted-out position for someone to lie on and, in the oblique perspective view shown in FIG. 1*b*, is shown in a basic position.
Figure 1B:
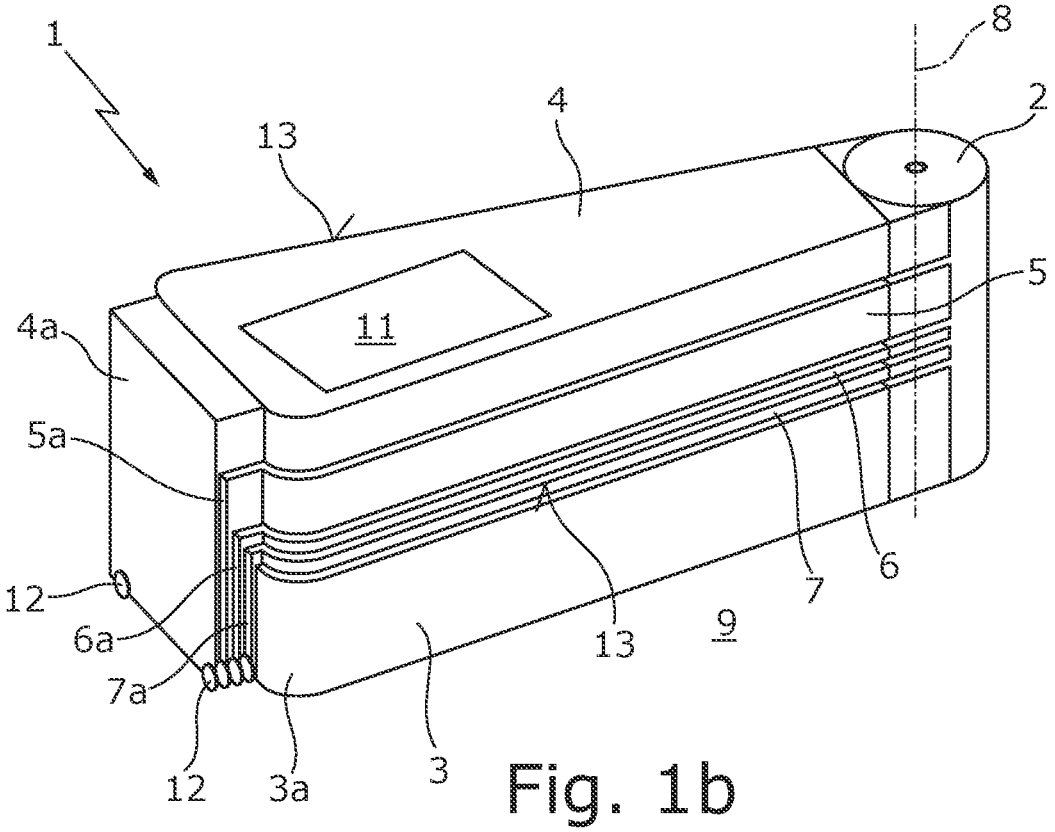

The furniture item 1 shown in FIGS. 1*a*, 1*b* has a vertical rotary column 2, about which a wedge-shaped bed 3 and, optionally, further wedge-shaped functional elements 4-7, each at different heights above the bed 3, are mounted in a freely rotatable manner. The bed 3 and the functional elements 4-7 taper in a wedge-shaped manner in the direction towards to the rotary column 2, or to the vertical axis of rotation 8 thereof, and are mounted in a rotatable manner on the rotary column 2 at their tapering, possibly rounded or truncated, end. The rotary column 2 either can be anchored in a non-displaceable manner on the floor 9, so that the axis of rotation 8 is thereby firmly predefined in space, or can be displaceable on the floor 9, so that the furniture item 1 together with the axis of rotation 8 can be positioned as desired in space. Supply lines, e.g. for power, network, incoming and outgoing water, etc., can run within the rotary column 2, and the bed 3 and the individual functional elements are connected thereto as required. The bed 3 and the functional elements 4-7 preferably have the same wedge-shaped outline.

The wider bed end 3*a*, which is directed away from the rotary column 2, expediently forms the head end, and the narrower bed end 3*b*, which is directed toward the rotary column 2, expediently forms the foot end, of the wedge-shaped bed 3. The lying surface of the bed 3 is denoted 10 and is in the form of a truncated wedge.

As shown merely by way of example in FIGS. 1*a*, 1*b*, the functional elements, as seen from top to bottom, can be an upper tabletop 4 for working in a standing position, a lower tabletop 5 for working in a sitting position and also a first and a second bench seat 6, 7. The upper tabletop 4 can be designed, for example, in the form of a kitchen worktop with electric power sockets and/or with electrical appliances, such as an integrated hob 11, which are connected to electric supply lines in the rotary column 3. The lower tabletop 5 can be utilized as a table for eating at and writing at and can have electrical interfaces, such as, for example, integrated power sockets or network connectors, which are connected to corresponding supply lines running in the rotary column.

At the wider bed end 3*a*, the bed 3 stands on the floor 9 by way of sliders or base rollers (not shown) on its underside, and these sliders or base rollers respectively slide or roll on the floor 9 when the bed 3 is rotated. At their wider end, which is directed away from the rotary column 2, the functional elements 4-7 have side panels 4*a*-7*a* with base rollers 12 on the underside, these base rollers allowing the functional elements 4-7 to stand on the floor 9 and to roll on the floor 9 when the functional elements 4-7 are rotated. If the rotary column 2 is sufficiently load-bearing, it is also possible to dispense with base rollers and side panels. In order for it to be possible for the bed 3 and functional elements 4-7 to be rotated in fan form relative to one another, the side panels 4*a*-7*a* and the base rollers 12 are arranged at different radii about the axis of rotation 8, wherein the side-panel radius is greater the higher the level of the respective functional element in the furniture item. The side panel 4*a* of the uppermost functional element 4 therefore has the greatest side-panel radius. The side-panel radius of the lowermost functional element 7 is greater than the radius of the wider bed end 3*a* in relation to the axis of rotation 8.

FIG. 1*a* shows the furniture item 1 in a fanned-out position, in which the bed 3 has been rotated into its position for someone to lie on and in which the bed 3 and all the functional elements 4-7 have been rotated in relation to one another. FIG. 1*b* shows the furniture item 1 in its fully closed, basic position, in which the bed 3 and all the functional elements 4-7 are arranged congruently one above the other and jointly form two flush sides 13 of the furniture item 1. If at least one of the functional elements 4-7, in particular the lowermost functional element 4, is located congruently above the bed 3, then this functional element forms a bed base, which serves to hide the bed from view and protect it from dust. It is optionally possible for a further functional element in the form of a stowage compartment to be arranged beneath the bed 3, the stowage compartment being mounted such that it can be rotated relative to the bed 3.

In contrast to what has been described above, one of the functional elements 4-7 can also be connected in a rotationally fixed manner to the rotary column 2, so that the basic position of the furniture item 1 is predefined in this way. In the fully closed, basic position, the bed 3 and all the other functional elements are then arranged congruently beneath or above this rotationally fixed functional element. As an alternative, it is also possible for the bed 3 to comprise the axis of rotation 8, so that all the functional elements 4-7 are rotated in relation to the rotationally fixed bed 3.

In contrast to what is shown in FIGS. 1*a*, 1*b*, it is advantageously also possible for a further functional element of at least 20 cm in height (not shown) to be arranged between the upper bench seat 6 and the lower tabletop 5, this further functional element, once rotated away by an appropriate distance, freeing up sufficient leg space between the upper bench seat 6 and the lower tabletop 5.

Instead of just one wedge-shaped bed 3, it is also possible for a plurality of wedge-shaped beds 3 to be mounted in a rotatable manner on the rotary column 2, each at different heights. A plurality of beds 3 can thus be stowed away in a space-saving manner and, if required, rotated in fan form in relation to one another into their respective position for someone to lie on.

It is possible for the furniture item 1, as shown in FIGS. 1*a*, 1*b*, to be arranged in island form in the space available or else to be integrated in a further furniture item, such as, for example, in a wall cabinet. In the former case, the bed 3 and the functional elements 4-7 have a range for rotation of 360° available to them for fanning-out purposes, whereas, in the latter case, the range for rotation is significantly restricted by the further furniture item.

Figure 2:
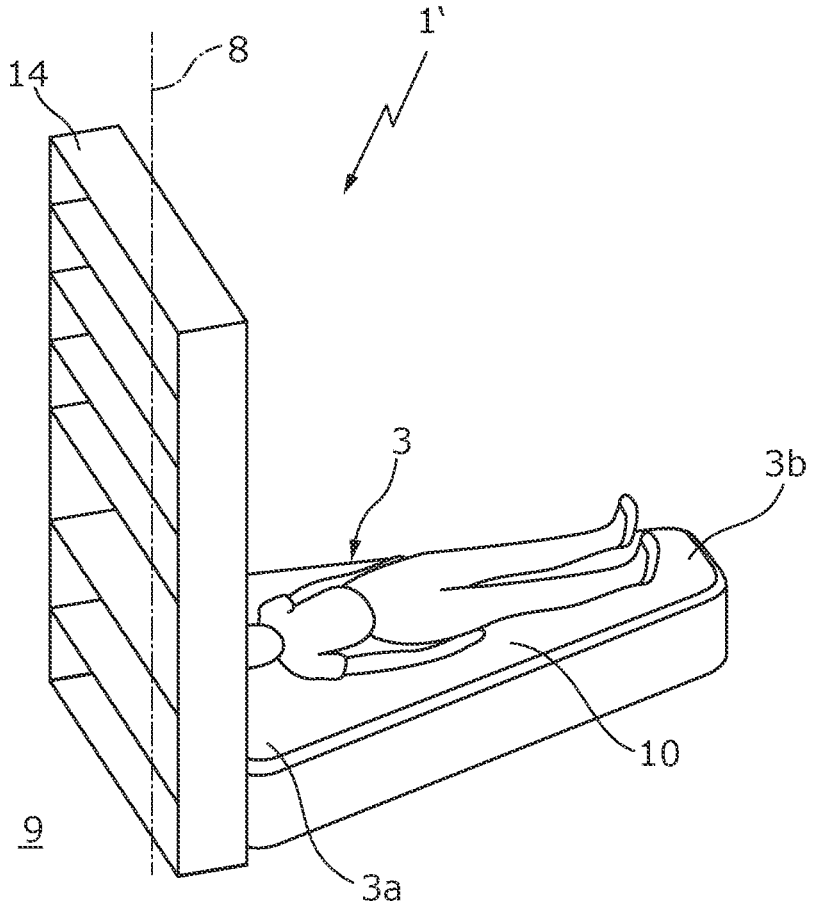
FIG. 2 shows an oblique perspective view of a further furniture item with a wedge-shaped bed which is fastened on a rotating shelf unit.

FIG. 2 shows a further furniture item 1' with a wedge-shaped bed 3, of which one bed end (in this case, merely by way of example, the wider bed end 3*a*) is fastened on a rotary part 14 (in this case illustrated, merely by way of example, as a rotary wall or space divider or rotating shelf unit), which is mounted such that it can be rotated about a vertical axis of rotation 8, which is stationary in space or is displaceable in space. The axis of rotation 8 is preferably in the form of a shaft which is fastened on the floor 9 and on the ceiling. For the case where the axis of rotation 8 is a hollow shaft, supply lines can run within the same, in order to supply power, for example, to a reading light provided on the bed 3.

It is also the case here that the wider bed end 3*a*, which is directed toward the rotating shelf unit 14, expediently forms the head end, and the narrower bed end 3*b*, which is directed away from the rotating shelf unit 14, expediently forms the foot end, of the wedge-shaped bed 3. The bed 3 and its lying surface 10 are in the form of a truncated wedge.

As shown in FIG. 2, the wider bed end 3*a* is approximately the same width as the rotating shelf unit 14, but it could also be significantly wider or narrower. Instead of running in the center of the rotating shelf unit 14, as shown, it is also possible for the axis of rotation 8 to run excentrically, e.g. at a corner of the rotating shelf unit. The bed 3, which is fastened on the rotating shelf unit 14, serves as a lever arm, so that the rotating shelf unit 14 together with the bed 3 can be rotated more easily about the axis of rotation 8. As an option, it is possible for the bed 3, at least at its narrower end 3*b*, to have base sliders or base rollers (not shown), which respectively slide or roll on the floor 9 when the bed 3 is rotated.

When not in use, the bed 3 can be rotated to a side which is directed away from the space available, so that it cannot be seen from this space and the rotating shelf unit 14 can be utilized as a shelf unit. By continuing to rotate the rotating shelf unit 14, or by rotating it back, the bed 3 can be rotated once again into a use position, directed towards the space available.

What is claimed is:

1. A furniture item, comprising:

at least one wedge-shaped bed, at least one wedge-shaped functional element and a vertical axis of rotation, about which at least one of the at least one bed and the at least one wedge-shaped functional element is mounted in a rotatable manner;

wherein the axis of rotation is arranged at one of the two ends of the bed, wherein the at least one bed and the at least one functional element have the same wedge-shaped cross section, and wherein, in a basic position of the furniture item, the at least one bed and the at least one functional element are arranged congruently one above the other.

2. The furniture item as claimed in claim 1, wherein the at least one bed and the at least one functional element are arranged at different heights.

3. The furniture item as claimed in claim 1, wherein the at least one bed and a plurality of functional elements are arranged at different heights and are mounted such that they can be rotated relative to one another about the axis of rotation.

4. The furniture item as claimed in claim 1, wherein the axis of rotation is in the form of a rotary column of the furniture item.

5. The furniture item as claimed in claim 4, wherein supply connections for the at least one bed or the at least one functional element are integrated in the rotary column.

6. The furniture item as claimed in claim 1, wherein the at least one bed comprises the axis of rotation, about which the at least one functional element is mounted in a rotatable manner.

7. The furniture item as claimed in claim 1, wherein the at least one functional element is arranged above the at least one bed and, in a basic position of the furniture item, fully covers the at least one bed in the upward direction.

8. The furniture item as claimed in claim 1, wherein, in the basic position of the furniture item, the at least one bed and a plurality of the functional elements are arranged congruently one above the other.

9. The furniture item as claimed in claim 1, wherein, in a position in which someone can lie on the furniture item, the at least one bed and the at least one functional element have been rotated in fan form in relation to one another.

10. The furniture item as claimed in claim 1, wherein the at least one bed and/or the at least one functional element have/has sliders or base rollers, which slide or roll on the floor when the at least one bed or the at least one functional element is rotated.

11. The furniture item as claimed in claim 10, wherein the sliders or base rollers are arranged at different radii about the axis of rotation.

12. The furniture item as claimed in claim 1, wherein the axis of rotation is arranged in a stationary manner in space or so as to be displaceable in space.

13. The furniture item as claimed in claim 1, wherein the at least one functional element comprises the axis of rotation, about which the at least one bed is mounted in a rotatable manner.

14. The furniture item as claimed in claim 13, wherein the at least one bed and further functional elements are mounted in a rotatable manner about the axis of rotation.

* * * * *